United States Patent [19]

Hankis

[11] 4,007,870

[45] Feb. 15, 1977

[54] NEWSPAPER DELIVERY BOX SIGNAL

[75] Inventor: John L. Hankis, Greenville, Mich.

[73] Assignee: Roy A. Hankis, Troy, Mich.

[22] Filed: Dec. 3, 1975

[21] Appl. No.: 637,366

[52] U.S. Cl. ..... 232/34; 232/1 C

[51] Int. Cl.[2] ..... A47G 29/12

[58] Field of Search ..... 232/34, 35, 17, 1 C

[56] References Cited

UNITED STATES PATENTS

| | | | |
|---|---|---|---|
| 1,904,448 | 4/1933 | Hampden et al. | 232/1 C |
| 2,496,962 | 2/1950 | Shaw | 232/34 |
| 2,553,164 | 5/1951 | Bishop | 232/34 |
| 3,386,649 | 6/1968 | Joyce | 232/34 |
| 3,520,568 | 7/1970 | White et al. | 16/150 X |
| 3,676,896 | 7/1972 | Maleck | 16/150 |
| 3,888,409 | 6/1975 | Bolduc | 232/34 X |

*Primary Examiner*—James T. McCall
*Assistant Examiner*—Peter A. Aschenbrenner
*Attorney, Agent, or Firm*—Cullen, Settle, Sloman & Cantor

[57] ABSTRACT

A signal for mounting upon a conventional newspaper delivery box, comprising a molded flap-hinge-clamp unit for releasably clamping upon the upper edge of the open forward end of the box with the flap arranged within and blocking the box opening. The flap pivots upwardly upon insertion of a newspaper within the box. A signal flag is connected to the flap and has a body portion arranged above and roughly parallel to the upper surface of the box so that when the flap pivots upwardly, the flag swings into an upright signalling position.

7 Claims, 7 Drawing Figures

FIG. 1
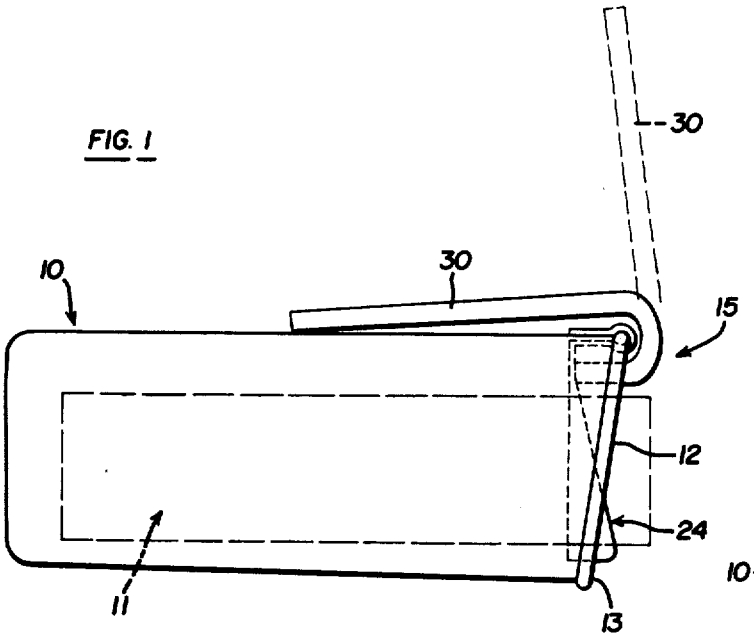
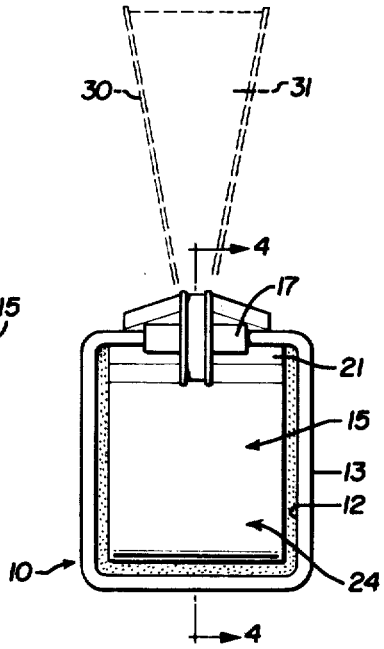
FIG. 2
FIG. 3
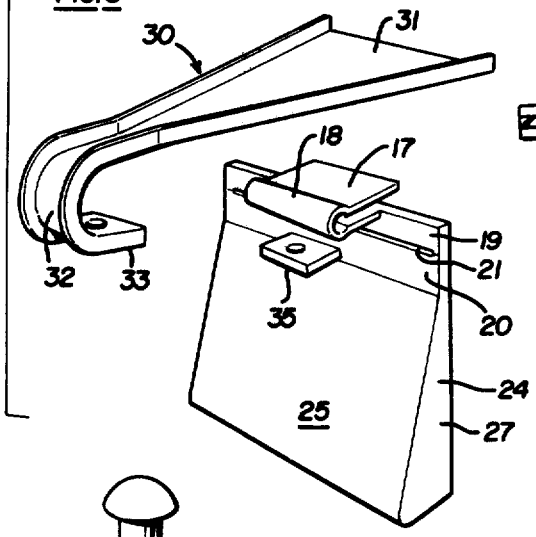
FIG. 4
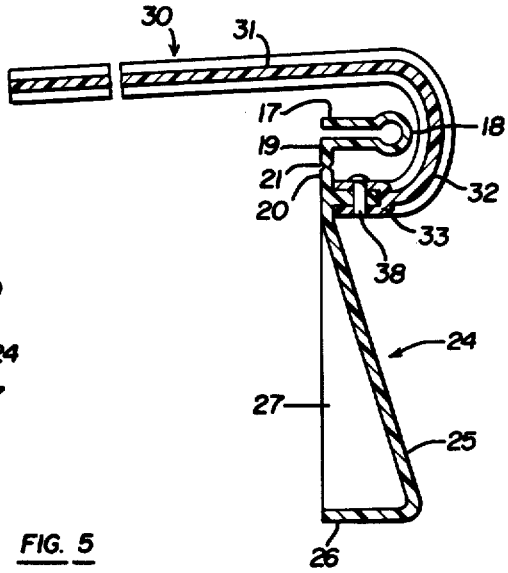
FIG. 5
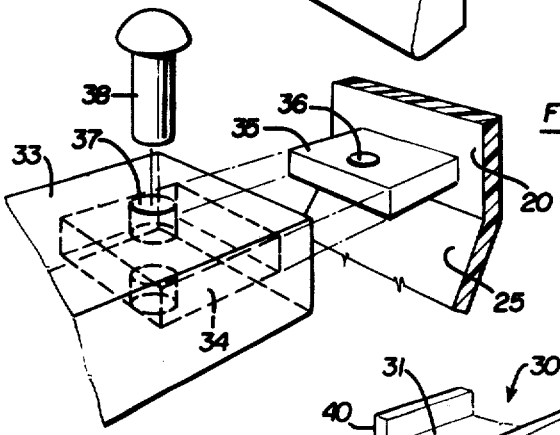
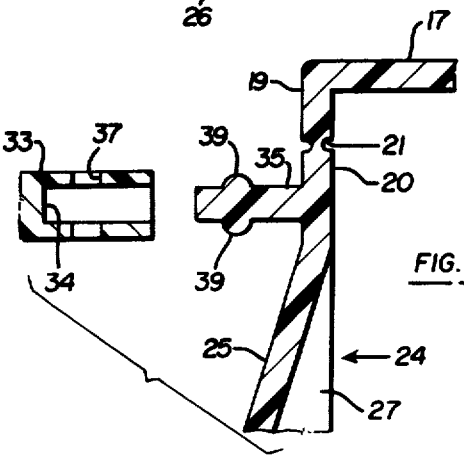
FIG. 6
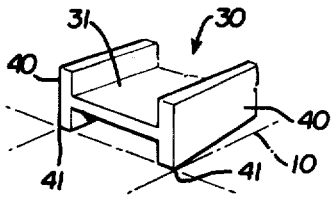
FIG. 7

NEWSPAPER DELIVERY BOX SIGNAL

BACKGROUND OF INVENTION

Conventional roadside newspaper delivery boxes are formed of horizontally elongated tubular sheet metal box-like construction which open horizontally towards the road, i.e., away from the building to which the newspaper is to be delivered. Such boxes are typically mounted upon metal posts driven into the ground. Hence, when a newspaper is inserted in the box, the newspaper cannot be seen except from the road, i.e, from the forward end of the box.

Various attempts have been made to provide signal devices on the newspaper boxes which will visually signal when a newspaper is within a box so that an observer from the building or house can determine the delivery of the newspaper without having to physically walk to the box and look inside. However, various types of proposed signal devices generally involved either modifying the newspaper delivery box or mechanically fastening the signal device to the box. Further, such earlier signal devices are of constructions which are relatively expensive to make and are susceptible to damage due to the elements, i.e., rain, snow, heat, etc.

By way of example of such type prior devices, the prior art U.S. Pat. Nos. to Hampden, No. 1,904,448 and Joyce 3,386,649, each illustrate signal devices of the general type involved here, but each requiring some physical fastening of the signal device to the box, including some modification of the box. Another prior art device illustrated in Bishop U.S. Pat. No. 2,553,164 illustrates a simple, easy to apply signal device but of a construction which is impractical because of relative cost and also susceptibility to damage from weathering, such as corrosion, breakage of springs, etc.

Thus, there has been a need for signal device which is extremely inexpensive, particularly since the newspaper boxes are normally provided without charge by the newspaper publishers or sellers, which can be installed on the box without any modification of the box and without any tools or skill, which can be handled and shipped with a minimum of space and packaging and which is substantially impervious to the elements.

SUMMARY OF INVENTION

The invention herein contemplates the formation of a simple, inexpensive, plastic molding forming a flap for blocking the open end of the newspaper box, an integral hinge portion and a clamp for frictionally clamping the flap within the open end of the newspaper box. A second plastic molding forms a signal flag which can be easily secured to the first molding to form the complete signal unit.

The signal flag may be formed integral with the flap-clamp-hinge unit to further reduce costs, however, for simplicity and handling and in packaging particularly, it is desirable to form the two units separately for joining together during installation on the newspaper box.

The clamp contemplated slips over and frictionally clamps the upper, forward edge of the newspaper box and can be installed by simply pushing it into place, which will then automatically locate the flap across and within the open front end of the box so that it may pivot upwardly and inwardly of the box upon being contacted by a newspaper inserted within the box. As the flap pivots, the flag which is connected to it, automatically flips into an up or signalling position. Conversely, when the newspaper is withdrawn, the flap is balanced in weight due to its construction so that it swings downwardly or into a roughly vertical position and thereby lowers the signal flag. The overall construction contemplated herein is extremely simple and inexpensive so that the entire device can be manufactured, delivered and sold at either a very low cost or even distributed without charge. In any event, no tools or skilled labor is required to install the device upon an existing newspaper delivery box.

Further objects and advantages of this invention will become apparent upon reading the following description of which the attached drawings form a part.

DESCRIPTION OF DRAWINGS

FIG. 1 is a side elevational view of a conventional newspaper box with the signal device herein installed.

FIG. 2 is a front end view of the box and signal device.

FIG. 3 is a perspective view of the two parts making up the signal device.

FIG. 4 is an enlarged cross-sectional view taken in the direction of arrows 4—4 of FIG. 2.

FIG. 5 is an enlarged, fragmentary, perspective view showing the connection between the flap and signal flag.

FIG. 6 shows a modified connection between the flap and signal flag.

FIG. 7 is a fragmentary perspective view of the end of the signal flag.

DETAILED DESCRIPTION

FIG. 1 illustrates a conventional newspaper delivery box 10 which receives newspapers and the like 11 through an open forward end 12 which is surrounded by an edge bead 13. Typically, such boxes are made out of sheet metal formed into a tubular, horizontally elongated shape or alternatively out of molded plastic of the same shape. Although the boxes may be round in cross-section, more conventionally they are formed in a roughly square cross-sectional shape. Such boxes are typically mounted by brackets upon a vertical post driven into the ground located adjacent a road near a building. Newspapers are placed into the box by a delivery person who is on the road and thus, the delivered papers are not visible from the rear of the box, that is, from the house or building.

The signal unit 15 includes a U-shaped clamp 17 having an enlarged bead receiving base portion 18 for receiving an upper edge portion of the forward end of the box with the bead 13 closely received within the bead receiving base portion 18. The lower leg of the clamp is integral with an upper hinge portion 19, in turn integral with a lower hinge portion 20 at a narrowed hinge line 21. The lower hinge portion is integral with a flap 24 which is illustrated as comprising a forward wall 25, a bottom wall 26 and triangular side walls 27 so that it forms a hollow structure opening forwardly of the box. The physical configuration of the flap may be varied with the object of properly balancing or weighing the flap so that it tends to remain in an upright position and tends to swing back into an upright position automatically.

The foregoing structure is molded as a single unit out of a suitable plastic material, that is, a plastic which has sufficient resiliency to provide the necessary frictional clamping pressure of the clamp 17 as well as the hinging ability of the hinge line 21.

A signal flag 30 is formed with a widened signal portion 31, a curved around forward base or end 32 terminating in a lower socketed end 33 having a socket 34. A stud 35 formed on the lower hinge portion 20 is sized to fit into the socket 34 and aligned openings 36 and 37 in the stud and socket respectively receive a pin or screw 38 for interconnecting the signal flag to the flap.

With this construction, the signal flag may be molded of a more colorful plastic material so that it shows from a considerable distance and also, may be shipped more easily as it may be laid flat upon the clamp-hinge-flap unit and thus easily packaged together.

As can be seen, the flap unit may be applied to any conventional delivery box simply by pushing the clamp 17 over the upper edge of the box. The person applying the device may then easily connect the flag to the flap by aligning the stud within the socket and dropping the pin 38 into place. Alternatively, a suitable screw or a nut and bolt of appropriate size may be used. Once applied, the flap acts as a closure for the box to protect the interior against the elements.

FIG. 6 illustrates a modification wherein the stud 35 is provided with pin-like enlargements or bumps 39 so that when the stud is inserted into the socket 34, the enlargements snap into the holes 37 in the socket to secure the two units together and thereby eliminate the need for separate pins or the like.

As illustrated in FIG. 7, the signal flag is generally H-shaped in cross-section, so that the lower ends of the vertical legs 40 make point contacts at 41 with the upper surface of the box. Thus, freezing of the flag to the box, e.g., as by ice or snow, is substantially eliminated.

Having fully described an operative embodiment of this invention, I now claim.

1. In a newspaper delivery box signal for mounting within a horizontally elongated, roughly tubular shaped box having an open forward end to receive a newspaper and the like, comprising: a flap sized to fit within said box and biased for normally being generally vertical for thereby blocking the box open end; a horizontally arranged U-shaped clamp for receiving and resiliently clamping to the upper, central edge portion of the box forward end for removable attachment thereto, and so that one leg of the clamp is thereby arranged within the box; hinge means connecting said clamp to the flap, whereby the flap may pivot inwardly and upwardly relative to the box forward end; and an elongated signal flag means, said signal flag means extending upwardly and then rearwardly of the box so that a major portion of the flag means is normally arranged above and roughly parallel to the upper surface of the box; the improvement comprising:

said clamp being positioned vertically above said flap;

said hinge means being positioned intermediate said clamp and said flap and being permanently attached to both said clamp and said flap; and connection means vertically beneath both said clamp and said hinge means for securing said signal means to said flap so that said signal flag means aids in biasing said flap generally vertically, said connection means including a stud portion formed integral with said flap near the upper end portion thereof, and a socket formed in one end of said flag means for receiving said stud, and means for locking the stud within the socket;

whereby the insertion of a newspaper or the like into the box through the open forward end thereof will pivot the flap inwardly of the box and thereby cause the flag means to swing upwardly relative to the box to a signal position and whereby the flag means normally, in the absence of or withdrawal of a newspaper from the box, will hang upright so that the signal means remains roughly horizontal in the non-signal position.

2. A construction as in claim 1, and with the lower part of the free end of the signal flag formed with a downwardly pointed portion to make substantially point contact with the upper surface of the box.

3. A construction as defined in claim 1, wherein said socket has a pair of aligned apertures therein, said stud has an aperture therein, and said locking means includes a pin for insertion through the apertures in said socket and said stud.

4. A construction as defined in claim 1, wherein said socket has at least one aperture therein and said locking means includes a projection on said stud for engagement with said socket aperture.

5. A contruction as defined in claim 1, and said flap, hinge means and clamp, being a molded, integral, one-piece plastic unit.

6. A construction as defined in claim 5, and said flap being formed in roughly a triangular cross-sectional shape, with a forward wall, a bottom wall and a pair of opposed triangular shaped walls joined together, and with the upper edge of the flap being integral with the clamp leg which is arranged within the box and with a bendable hinge line integrally formed between the clamp leg and flap, whereby the flap is balanced to normally hang in and to automatically return to an upright position beneath the clamp to thereby block the box forward end.

7. A construction as defined in claim 1 and said flap, hinge means and clamp being a molded, integral, one-piece plastic unit;

with the upper edge of the flap being integral with the clamp leg which is arranged within the box and with a bendable hinge line integrally formed between the clamp leg and flap, wherein the flap is balanced to normally hang in and to automatically return to an upright position beneath the clamp for blocking the box open front end.

* * * * *